US007980397B2

(12) United States Patent
Noda et al.

(10) Patent No.: US 7,980,397 B2
(45) Date of Patent: Jul. 19, 2011

(54) GLASS PLATE PACKAGING PALLET AND GLASS PLATE PACKAGE BODY

(75) Inventors: Takayuki Noda, Otsu (JP); Michiharu Eta, Otsu (JP)

(73) Assignee: Nippon Electric Glass Co., Ltd., Shiga (JP)

( * ) Notice: Subject to any disclaimer, the term of this patent is extended or adjusted under 35 U.S.C. 154(b) by 0 days.

(21) Appl. No.: 12/517,656

(22) PCT Filed: Nov. 8, 2007

(86) PCT No.: PCT/JP2007/071715

§ 371 (c)(1),
(2), (4) Date: Jun. 4, 2009

(87) PCT Pub. No.: WO2008/068998

PCT Pub. Date: Jun. 12, 2008

(65) Prior Publication Data

US 2010/0065518 A1 Mar. 18, 2010

(30) Foreign Application Priority Data

Dec. 7, 2006 (JP) ..... 2006-331031

(51) Int. Cl.
*A47G 19/08* (2006.01)

(52) U.S. Cl. ..... 211/41.14

(58) Field of Classification Search ..... 211/41.14, 211/41.2, 37, 13.1, 42, 59.2, 87.01; 206/454; 248/441.1, 446, 453; 312/323, 231; 108/27, 108/6

See application file for complete search history.

(56) References Cited

U.S. PATENT DOCUMENTS

| | | | | |
|---|---|---|---|---|
| 1,960,805 | A * | 5/1934 | Clark et al. | 211/41.14 |
| 2,005,099 | A * | 6/1935 | McLeod | 211/41.14 |
| 2,379,213 | A * | 6/1945 | Black | 269/296 |
| 2,839,198 | A * | 6/1958 | Lefevre | 211/41.14 |
| 2,978,270 | A * | 4/1961 | Verheggen | 294/67.22 |

(Continued)

FOREIGN PATENT DOCUMENTS

CN 1621324 6/2005

(Continued)

OTHER PUBLICATIONS

Chinese Office Action issued Apr. 13, 2010 in corresponding Chinese Application No. 200780042488.2 w/English translation.

(Continued)

*Primary Examiner* — Darnell M Jayne
*Assistant Examiner* — Patrick Hawn
(74) *Attorney, Agent, or Firm* — Wenderoth, Lind & Ponack L.L.P.

(57) ABSTRACT

A glass plate packaging pallet includes a pallet base formed by integrating a base part and a backside part rising from a rear side of the base part, and a mount body formed by integrating a pedestal part and a backrest part, the pedestal part being placed above the base part and supporting from below a plurality of glass plates disposed so as to be stacked with an upright posture, the backrest part being placed in front of the backside part and supporting the glass plates resting thereagainst, and is configured such that a rear surface of the backrest part and a front surface of the backside part are fixed together so as to face each other along the same plane, and that the pedestal part is positioned in a non-connected state with respect to the base part.

12 Claims, 4 Drawing Sheets

U.S. PATENT DOCUMENTS

| | | | | |
|---|---|---|---|---|
| 3,412,867 | A * | 11/1968 | Barkow | 211/41.14 |
| 3,955,676 | A * | 5/1976 | Hansen et al. | 206/451 |
| 4,626,017 | A * | 12/1986 | Robertson | 296/3 |
| 4,688,976 | A * | 8/1987 | Rowley et al. | 410/156 |
| 5,676,066 | A * | 10/1997 | Cavalier et al. | 108/55.1 |
| 5,906,282 | A * | 5/1999 | Aldrich et al. | 211/41.14 |
| 6,102,206 | A * | 8/2000 | Pride | 206/454 |
| 6,386,376 | B1 * | 5/2002 | Mendoza-Castillo et al. | 211/41.14 |
| 7,264,126 | B1 * | 9/2007 | Bergeron | 211/41.14 |
| 2003/0173314 | A1 * | 9/2003 | Knoll et al. | 211/41.14 |
| 2003/0196971 | A1 * | 10/2003 | Jeskey et al. | 211/41.14 |
| 2004/0245195 | A1 * | 12/2004 | Pride | 211/41.14 |
| 2005/0201841 | A1 * | 9/2005 | Summers | 410/32 |
| 2006/0043032 | A1 * | 3/2006 | McHugh | 211/41.14 |
| 2006/0213846 | A1 * | 9/2006 | Edwards et al. | 211/41.14 |
| 2009/0057182 | A1 * | 3/2009 | Kamitani et al. | 206/451 |
| 2010/0000894 | A1 * | 1/2010 | Noda et al. | 206/386 |

FOREIGN PATENT DOCUMENTS

| | | | |
|---|---|---|---|
| EP | 1 533 250 | | 5/2005 |
| JP | 52-142070 | | 10/1977 |
| JP | 3-93437 | | 9/1991 |
| JP | 2000203679 | A * | 7/2000 |
| JP | 2005-132490 | | 5/2005 |
| JP | 2005-170399 | | 6/2005 |
| JP | 2005-239184 | | 9/2005 |
| JP | 2005231657 | A * | 9/2005 |

OTHER PUBLICATIONS

International Search Report mailed Jan. 15, 2008 for International Application No. PCT/JP2007/071715.

International Preliminary Report on Patentability and Written Opinion of the International Searching Authority mailed Jun. 18, 2009 for International Application No. PCT/JP2007/071715.

* cited by examiner

GLASS PLATE PACKAGING PALLET AND GLASS PLATE PACKAGE BODY

BACKGROUND OF THE INVENTION

I. Technical Field

The present invention relates to a glass plate packaging pallet and a glass plate package body, and more particularly, to technology for adequately mounting a plurality of glass plates so as to be disposed so as to be stacked with an upright posture on a glass plate packaging pallet provided with a pallet base which has a base part and a backside part integrated with each other.

II. Description of Related Art

As is well known in transporting various glass plates typified by glass substrates for flat-panel displays, such as a liquid crystal display, a plasma display, an electroluminescence display, and a field emission display, a glass plate packaging pallet is usually used. This glass plate packaging pallet basically is structured so that a plurality of glass plates are mounted thereon in a stacked state with a protective sheet, such as inserting paper intervening between the individual glass plates.

In that case, a glass plate packaging pallet is widely used on which individual glass plates are arranged in an upright posture and which includes a pallet base (pallet body) provided with a base part which constitutes a platform, and a backside part which rises from the rear side of the base part. In one example of the use mode, a plurality of glass plates are stacked and mounted on the base part, with a binding band or a stretch film wound around a periphery of the stacked glass plates so that the glass plates are bound and supported on the pallet base.

JP 2005-170399 A discloses, as this kind of a glass plate packaging pallet, a structure that has, in addition to a pallet base (L-shaped base member 13) which has a base part (bottom base member 9) and a backside part (back base member 11), a mount body (L-shaped retaining member 14) which integrally includes a pedestal part (bottom retaining member 10) having a plurality of independent members receiving glass plates from below and a backrest part (back retaining member 12) against which the glass plates are rested. The glass plate packaging pallet is configured so that the backrest part of the mount body is rotatably coupled to the backside part of the pallet base, and so that the mount body is fixed when the mount body is inclined to a desired inclination angle position.

JP 2005-132490 A described below discloses a container box which has a pedestal part (bottom receiving plate 14) placed on the top surface of a bottom piece 12 provided on a base part (bottom plate 3), and a backrest part (back receiving plate 15) resting against a vertical piece 13 fixed while extending across a rear plate 6 attached on the base part to serve as a part of the box, and the base part. Therefore, the L-shaped mount body in the container box comprises the bottom receiving plate 14 and the back receiving plate 15.

SUMMARY OF THE INVENTION

After a plurality of glass plates are arranged and packed in a stacked state on the mount body fixed to the pallet base, glass plate packaging pallets may be temporarily laid on a floor surface, and then loaded on the load-carrying platform or the like of a truck for transportation. Since the floor, the load-carrying platform or the like usually has irregularities on its top surface, the base part which serves as the bottom of the pallet may deform so as to match the irregularities. Such deformation of the base part of the pallet may also occur at the time the package body is lifted so as to be loaded on the load-carrying platform or the like of a truck with the base part being supported by the forks of a forklift. In this case, however, the full weight of the package body acts only on the portion where the base part and the forks of the forklift contact, and hence the deformation becomes more prominent.

Like the glass plate packaging pallet disclosed in JP 2005-170399 A, with a structure in which the backrest part of the mount body is fixed while being rotatably coupled to the backside part of the pallet base, the weight of a plurality of glass plates arranged in a stacked state on the mount body inevitably acts from the mount body on the backrest part through the rotatable coupled portion and acts from the backside part on the base part. Further, when there are a large number of glass plates, or the glass plates are large, for example, excessive weight acts on the rotatable coupled portion, thereby reducing durability of the coupled portion, and a force acts to rotate the mount body about the coupled portion, and hence the mount body may rattle or wobble. Moreover, the glass plate packaging pallet needs a mechanism for restricting the rotation of the mount body with respect to the pallet base to fix the mount body and the pallet base together. In consideration of an increase or the like in the weight of glass plates in the recent years, however, it has become very difficult to securely fix the mount body to the pallet base. Therefore, when vibration, a shock, or the like occurs in the base part of the pallet base, an undesirable shake or positional misalignment may occur on the mount body. With the above matter taken into consideration, when the base part of the pallet base is deformed as described above, the mount body rattles or wobbles, or shakes or has a positional misalignment. This may lead to deformation of the glass plates supported on the mount body. This causes the glass plates to be broken, and particularly increases the probability of occurrence of breakage of the glass plates resulting from the concentration of undesirable stress at the bottom side portions of the glass plates.

Above-mentioned JP 2005-132490 A discloses not a pallet for packing glass plates but a container box, which includes a bottom plate 3, a rear plate 6, a front plate 5, both side plates 7, and a top plate 4, and has a fundamental problem of being large and, thus an increase in weight. In light of the current situation where, like glass substrates for the recent flat panel displays, the size of glass plates is increased, this type of problem is serious. In addition, the bottom receiving plate 14 and the back receiving plate 15, which constitute the L-shaped mount body to be accommodated in the container box, are separated from each other, and the bottom receiving plate 14 is merely mounted while the back receiving plate 15 is merely set thereagainst. Therefore, it is apparent that the L-shaped mount body itself is not rigid, and is not securely fixed in the container box, and hence when vibration, shock, or the like is generated at the base part, the bottom receiving plate 14 and the back receiving plate 15 suffer undesirable relative movement, positional misalignment, or rattling. With those matters taken into account, when the base part is deformed as described above, the mount body including the bottom receiving plate 14 and the back receiving plate 15 has positional misalignment or rattling. This results in the deformation of the glass plates supported on the mount body, and hence undesirable stress is particularly concentrated at the bottom side portions of the glass plates, thus increasing the probability of causing breakage as in the above-mentioned case.

In view of the above-mentioned situation, the first object of the present invention is to improve the correlational structure of a pallet base and a mount body to suppress rattling or positional misalignment of the mount body resulting from deformation of the base part of the pallet base and suppress deformation of the glass plates supported on the mount body, thereby suppressing, as much as possible, concentration of undesirable stress at the bottom side portions of the glass plates, and breakage of the glass plates resulting from the stress concentration.

According to the glass plate packaging pallet disclosed in above-described JP 2005-170399 A, on the other hand, if the spaced-apart distance between the pedestal part and the base part, the inclination angle of the mount body, etc. are not proper in relation to the full weight of glass plates, when the base part deforms as described above, the pedestal part may also deform. Further, if the material for the pallet, the rigidity of the backside part, the rigidity of the mount body, the fixing stiffness of the mount body to the backside part, etc. are not proper in relation to the full weight of the glass plates, the deformation may also be transmitted to the pedestal part from the backside part via the backrest part. In addition, also in the glass plate packaging pallet disclosed in above-mentioned JP 2005-132490 A, if the material for the pedestal part or the rigidity thereof, the material for the bottom piece 12 lying thereunder or the rigidity thereof, and the fixing stiffness of the bottom piece 12 to the mount body are not proper in relation to the full weight of the glass plates, the pedestal part may deform in accordance with the above-mentioned deformation of the base part.

When the pedestal part is not deformed, bottom side portions of the glass plates placed thereon evenly contact the top surface of the pedestal part across the entire length, whereas when the pedestal part is deformed in the above manner, only a part of the bottom side portions of the glass plates contact the top surface of the pedestal part in an uneven state. This results in the deterioration in a support state of the bottom side portions of the glass plates. In particular, undesirable stress is concentrated at a part of the bottom side portions of the glass plates, which brings about a problem such as breakage of the glass plates.

In view of such a situation, the second object of the present invention is to suppress, as much as possible, concentration of undesirable stress at the bottom side portions of the glass plates, which is caused by the deformation of the pedestal part of the mount body occurring in accordance with the deformation of the base part of the pallet base, and breakage of the glass plates resulting from the stress concentration.

The present invention, which has been made for solving the first object, provides a glass plate packaging pallet, comprising a pallet base formed by integrating a base part and a backside part rising from a rear side of the base part, the glass plate packaging pallet being configured so that a plurality of glass plates are disposed so as to be stacked with an upright posture above the base part and in front of the backside part, wherein:

the glass plate packaging pallet further comprises a mount body formed by integrating a pedestal part and a backrest part, the pedestal part being placed above the base part and supporting from below the glass plates, the backrest part being placed in front of the backside part and supporting the glass plates resting thereagainst; and the glass plate packaging pallet is configured such that:

a rear surface of the backrest part and a front surface of the backside part are fixed together so as to face each other along the same plane so that the mount body is fixed to the pallet base only with use of the backrest part; and the pedestal part is positioned in a non-connected state with respect to the base part so that force of deformation of the backside part involved with deformation of the base part is received between the front surface of the backside part and the rear surface of the backrest part. The expression "in a non-connected state" means that the pedestal part of the mount body is not directly coupled or fixed to the base part of the pallet base (the same is applied to the following description).

With such a configuration, when the base part of the pallet base deforms, the backside part also tends to deform in response thereto, but the force to deform the backrest part is received between the front surface of the backside part of the pallet base and the rear surface of the backrest part of the mount body. In this case, the front surface of the backside part and the rear surface of the backrest part face each other along the same plane, and in this state, the backside part and the backrest part are fixed to each other. Therefore, the force to deform the backside part is received between the opposed sides of the backside part and the backrest part, thus suppressing undesirable rattling or positional misalignment of the mount body. Because the pedestal part of the mount body is set in a non-connected state with respect to the base part of the pallet base, it is possible to adequately suppress the direct influence of the deformation of the base part on the mount body. As a result, it becomes difficult for undesirable stress to be concentrated at the bottom side portions of the plurality of glass plates arranged in a stacked state on the mount body, thus making it possible to reduce the probability of occurrence of a crack or so of glass plates.

The present invention, which has been made for solving the second object, provides a glass plate packaging pallet, comprising a pallet base formed by integrating a base part and a backside part rising from a rear side of the base part, the glass plate packaging pallet being configured so that a plurality of glass plates are disposed so as to be stacked with an upright posture above the base part and in front of the backside part, wherein:

the glass plate packaging pallet further comprises a mount body formed by integrating a pedestal part and a backrest part, the pedestal part being placed above the base part and supporting from below the glass plates, the backrest part being placed in front of the backside part and supporting the glass plates resting thereagainst; and the mount body is configured so as to be fixed to the pallet base only with use of the backrest part, and the pedestal part is positioned in a non-connected state with respect to the base part so as not to deform in response to deformation of the base part. The expression "pedestal part configured not to be responsive to the deformation of the base part" means to include not only the pedestal part configured so that the entire pedestal part is not responsive to the deformation of the base part, but also the pedestal part configured so that, while the pedestal part is partly responsive to the deformation of the base part, the surface of the pedestal part which contacts the bottom side portions of the glass plates does not deform in response to the deformation of the base part.

With such a configuration, when the base part of the pallet base deforms, the backside part also deforms in response thereto, and the mount body fixed to the backside part also tends to deform but is fixed to the pallet base only with use of the backrest part. What is more, the pedestal part of the mount body is in a non-connected state with respect to the base part and is configured not to deform in response to the deformation of the base part. Thus, even when the base part deforms, the state of support of the bottom side portions of the glass plates by the pedestal part is not influenced by the deformation of the base part and is kept properly. That is, in the glass plate packaging pallet, the materials for the pallet base and the mount body, the inclination angle of the mount body, the positional relation between the pedestal part and the base part, the rigidity of the backside part, the rigidity of the mount body, the fixing stiffness of the mount body to the backside part, etc. are properly set in relation to the full weight of glass plates, and hence the pedestal part does not deform in response to the deformation of the base part. Therefore, the above-mentioned advantage can be enjoyed. This prevents undesirable stress from being concentrated at the bottom side portions of the glass plates, thus making it possible to reduce the problem of causing breakage such as a crack of glass plates as much as possible.

With the above-mentioned configuration, it is preferred that the pedestal part of the mount body be an integrated structure.

This suppresses independent deformation or so of the individual members when the pedestal part, like the one described in JP 2005-170399 A, includes a plurality of independent members, making it possible to keep the stable support of the bottom sides of the glass plates over the entire thereof.

With the above-mentioned configuration, a clearance may be provided between a bottom of the pedestal part of the mount body and a top surface of the base part of the pallet base, and a cushion member may be provided so as to interpose therebetween.

In the former case, the presence of the clearance can appropriately control the transmission of the deformation of the base part to the pedestal part, which is advantageous in suppressing undesirable stress concentration generated at the bottom side portions of glass plates. In the latter case, the presence of the cushion member can relax the transmission of vibration or shock occurring at the base part to the pedestal part, which is advantageous in restraining undesirable stress from acting at the bottom side portions of glass plates.

With the above-mentioned configuration, a glass plate receiving surface of the pedestal part of the mount body may include a single flat surface, or a flat surface divided into two or more parts in a direction perpendicular to a front-back direction.

In the former case, the linear lower side of the glass plate is evenly supported over the entire length by the single flat surface, whereas in the latter case, the linear lower side of the glass plate is evenly supported at a plurality of locations by the flat surface divided into two or more parts.

With the above-mentioned configuration, the backside part is integrated on the base part of the pallet base in an elastically supported state. In this case, the backside part may be attached onto the base part of the pallet base through the intermediation of the cushion member.

With the structure, the base part and the backside part of the pallet base are not coupled or fixed directly, and the backside part is elastically supported on the base part. As a result, the deformation of the base part, or vibration or shock thereon is not directly transmitted to the backside part. Therefore, the deformation or so of the base part is not inevitably transmitted to the mount body fixed to the backside part, and hence the support state of the glass plates is well maintained. Further, the intervention of the cushion member between the base part and the backside part advantageously relaxes shock in particular which would otherwise be transmitted from the base part to the backside part, and eventually to the mount body.

With the above-mentioned configuration, it is preferred that an angle defined by a front surface of the backrest part of the mount body and a vertical plane have a lower limit set to 0° and an upper limit set to an inclination angle of 45° at which a lower side of the front surface of the backrest part comes frontward more than an upper side of the front surface of the backrest part.

Namely, if the angle defined by the front surface of the backrest part of the mount body (surface of the backrest part against which glass plates are rested) and the vertical plane lies within the above-mentioned numerical range, the resting angle of each glass plate becomes adequate, thus making it possible to pile the individual glass plates one on another in a good upright posture without causing a significant deformation at the time of piling the glass plates. With this matter taken into account, it is preferred that the angle defined by both of the surface and plane has its lower limit set to an inclination angle of 10° at which the lower side of the front surface of the backrest part comes frontward more than the upper side of the front surface of the backrest part, and has its upper limit set to an inclination angle of 26.5° in the same direction.

With the above-mentioned configuration, it is preferred that an angle defined by a top surface of the pedestal part of the mount body and a horizontal plane have a lower limit set to 0° and an upper limit set to an inclination angle of 75° at which a rear side of the top surface of the pedestal part comes downward more than a front side of the top surface of the pedestal part.

That is, if the angle defined by the top surface of the pedestal part of the mount body (surface which the bottom side of each glass plate contacts) and the horizontal plane lies within the above-mentioned numerical range, slipping or the like is difficult to occur between each glass plate and the top surface of the pedestal part, thus making it possible to stably support the glass plates on the top surface of the pedestal part. With this matter taken into account, it is preferred that the angle defined by both of the surface and plane has its lower limit set to an inclination angle of 10° at which the rear side of the top surface of the pedestal part comes downward more than the front side of the top surface of the pedestal part, and has its upper limit set to an inclination angle of 56.5° in the same direction.

With the above-mentioned configuration, it is preferred that an angle defined by a front surface of the backrest part of the mount body and a top surface of the pedestal part has a lower limit set to 60° and an upper limit set to 135°, and an angle defined by the top surface of the pedestal part of the mount body and a horizontal plane has a lower limit set to 0°.

That is, given that the lower limit of the angle defined by the top surface of the pedestal part and the horizontal plane is set to 0°, if the angle defined by the top surface of the pedestal part and the front surface of the backrest part lies within the above-mentioned numerical range, it is possible to properly set the degree of closeness or contact pressure between the individual glass plates (particularly between the bottom side portions of the individual glass plates). This makes it possible to set the individual glass plates into a good stacked state. With this matter taken into account, it is preferred that the angle defined by both of the surface and plane has the lower limit of 90° and the upper limit of 120°.

On the other hand, a glass plate package body according to the present invention can be obtained by packing a plurality of glass plates disposed so as to be stacked with an upright posture so as to be arranged on the mount body of the glass plate packaging pallet including the above-mentioned configuration while interposing a protective sheet between the individual glass plates.

Because the same description as already given on the various kinds of glass plate packaging pallets can be applied to glass plate package bodies which use corresponding glass plate packaging pallets, their descriptions are omitted for the sake of convenience.

In the glass plate package body, it is preferred that each of the packed glass plates has a thickness of 0.7 mm or less, and one side with a size of 1,000 mm or more.

Employment of this structure enables adequate coping with recent upsizing and thinning of glass substrates for flat panel displays, in particular, glass substrates for liquid crystal displays.

According to the present invention which can solve the first object described above, the force to deform the backrest part which is caused by the deformation of the base part of the pallet base is received between the opposed sides of the backside part and the backrest part, thus suppressing undesirable rattling or positional misalignment of the mount body. In addition, it is possible to adequately suppress the direct influence of the deformation of the base part on the mount body due to the pedestal part of the mount body being set in a non-connected state with respect to the base part of the pallet base. As a result, it becomes difficult for undesirable stress to be concentrated at the bottom side portions of a plurality of glass plates arranged in a stacked state on the mount body, thus making it possible to reduce the probability of occurrence of a crack or so of glass plates.

According to the present invention which can solve the second object, even in a case where the backside part and the mount body fixed thereto are deformed due to the deformation of the base part of the pallet base, the mount body is configured so as to be fixed to the pallet base only with use of the backrest part, and the pedestal part of the mount body is set in a non-connected state with respect to the base part and is not deformed in response to the deformation of the base part, thus making it difficult for the state of support of the bottom side portions of glass plates by the pedestal part to be adversely affected by the deformation of the base part. This prevents undesirable stress from being concentrated at the bottom side portions of the glass plates, and hence occurrence of breakage of the glass plates, such as cracking thereof, is reduced as much as possible.

DETAILED DESCRIPTION OF THE INVENTION

Hereinafter, embodiments of the present invention are described with reference to the accompanying drawings.

Figure 1:
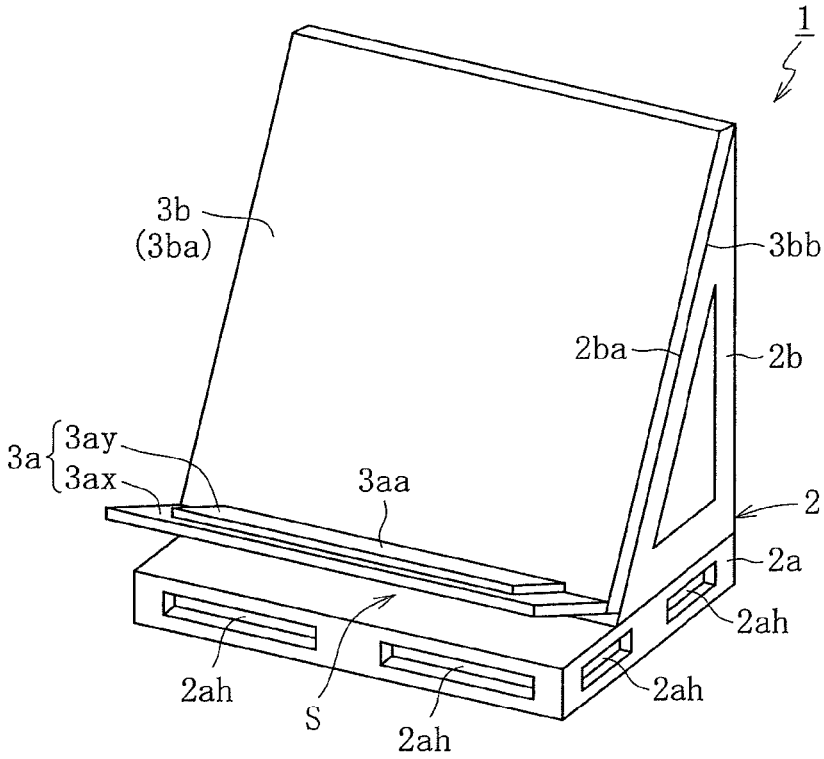
FIG. 1 is a perspective view schematically illustrating a glass plate packaging pallet according to a first embodiment of the present invention.
Figure 2:
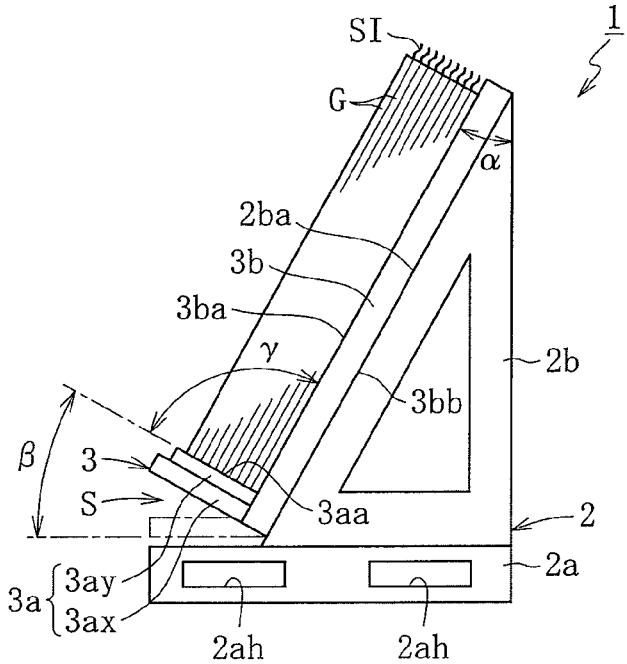
FIG. 2 is a side view schematically illustrating the glass plate packaging pallet according to the first embodiment of the present invention.

FIG. 1 is a perspective view schematically illustrating a glass plate packaging pallet (hereinafter simply referred to as "pallet") according to a first embodiment of the present invention. FIG. 2 is a side view schematically illustrating a state in which glass plates are stacked one on another on the pallet. As illustrated in the diagrams, the pallet 1 includes a pallet base 2 and a mount body 3 as main components, and the pallet base 2 and the mount body 3 have a frame formed of a metal, such as iron or stainless steel. The pallet base 2 is formed by integrating a base part 2*a* serving as a platform to be placed on a floor surface or the like, and a backside part 2*b* rising from the rear side of the base part 2*a*. The mount body 3 is formed by integrating a pedestal part 3*a* arranged above the base part 2*a* and supporting from below a plurality of glass plates G stacked one on another with an upright posture, and a backrest part 3*b* arranged in front of the backside part 2*b* and supporting the glass plates G resting thereagainst.

Specifically, the base part 2*a* of the pallet base 2 has a rectangular top surface in parallel to the bottom, and has side surfaces provided with a plurality of openings 2*ah* in which forks of a forklift are to be inserted. The backside part 2*b* of the pallet base 2 has an approximately right triangular shape as seen from the sides, with the bottom equivalent to the short side being fixed to the top surface of the base part 2*a* to be integrated with the base part 2*a*. A front surface 2*ba* equivalent to an oblique side of the backside part 2*b* constitutes a frame portion having a plurality of bars extended vertically and horizontally though not illustrated in detail. The backrest part 3*b* of the mount body 3 is a flat frame portion having a plurality of bars extended vertically and horizontally, though not illustrated in detail, with the flat pedestal part 3*a* being fixed to the lower end of the backrest part 3*b* to thereby form the mount body 3 integrated in an approximately L shape. The backrest part 3*b* has a front surface 3*ba* covered with a flat cushion member or the like.

The mount body 3 is fixed to the backside part 2*b* by connecting a rear surface 3*bb* of the backrest part 3*b* to the front surface 2*ba* of the backside part 2*b* by welding or using fastening members such as bolts. That is, in the mount body 3, only the backrest part 3*b* is fixed to the pallet base 2, while the pedestal part 3*a* has its bottom separated from the top surface of the base part 2*a* of the pallet base 2 through an intermediation of a clearance S, and is set in a non-connected state with respect to the base part 2*a*. Therefore, the mount body 3 is configured in such a way that the force which works to deform the backside part 2*b* in accordance with the deformation of the base part 2*a* of the pallet base 2 is received between the front surface 2*ba* of the backside part 2*b* and the rear surface 3*bb* of the backrest part 3*b*. Further, the pedestal part 3*a* of the mount body 3 is configured in such a way as not to deform in accordance with the deformation of the base part 2*a* of the pallet base 2. In this case, an inclination angle $\alpha$ with respect to the vertical plane of the backrest part 3*b* is set to 0° to 45°. The pedestal part 3*a* may be fixed to the backrest part 3*b* in a horizontal posture as indicated by a chain line in FIG. 2, with its inclination angle $\beta$ with respect to the horizontal plane being set to 0° to 75°. Further, an angle defined by the front surface 3*ba* of the backrest part 3*b* and the top surface 3*aa* of the pedestal part 3*a* is set to 60° to 135°.

Figure 3:
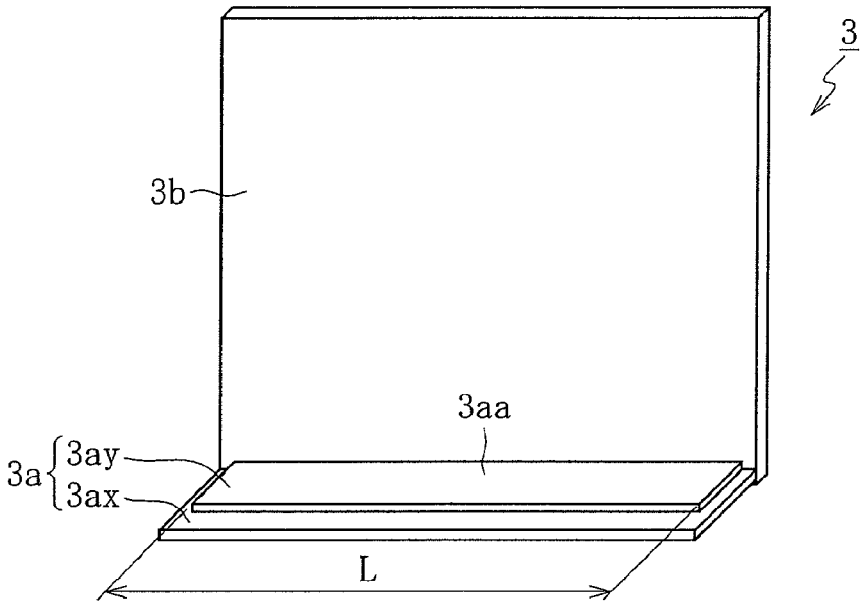
FIG. 3 is a perspective view schematically illustrating a mount body of the glass plate packaging pallet according to the first embodiment of the present invention.
Figure 4:
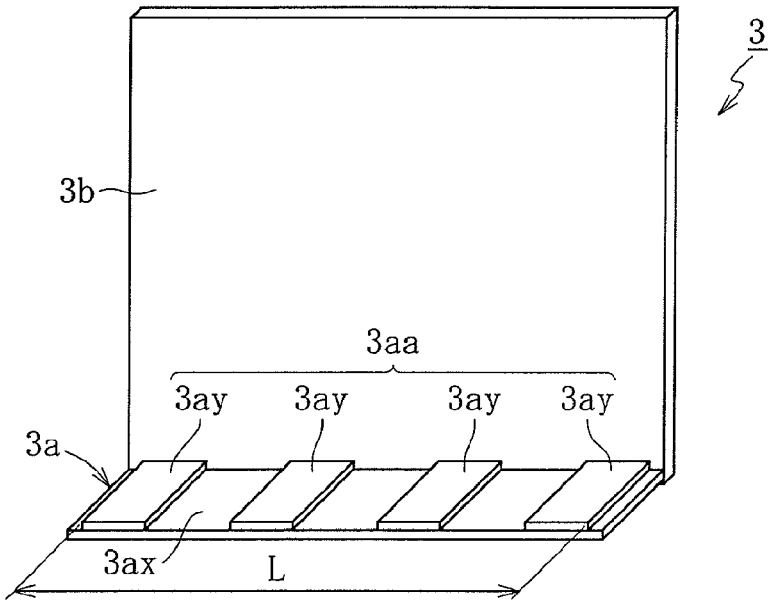
FIG. 4 is a perspective view schematically illustrating a modification example of the mount body of the glass plate packaging pallet according to the first embodiment of the present invention.

As illustrated in FIG. 3, specifically, the pedestal part 3*a* is an integral structure in which a receiving member 3*ay* made of a foaming resin or rubber is fixed on a plate-shaped pedestal base 3*ax* made of metal, and the top surface of the receiving member 3*ay* serves as a glass plate receiving surface 3*aa*. While it is preferred that the glass plate receiving surface 3*aa* support the bottom sides of the glass plates G across the entire bottom sides, it has only to have a length L long enough to support 90% or more of the bottom sides. The glass plate receiving surface 3*aa* of the pedestal part 3*a* need not be a single flat plane as illustrated in FIG. 3, and the glass plate receiving surface 3*aa* may be divided into a plurality of planes by fixing a plurality of receiving members 3*ay* on the pedestal base 3*ax* in a widthwise direction (direction orthogonal to the front-back direction) at predetermined intervals as illustrated in FIG. 4.

Note that, the mount body 3 and the pallet base 2 may be fixed together with a cushion member interposed between the rear surface 3*bb* of the backrest part 3*b* and the front surface 2*ba* of the backside part 2*b*. A cushion member may be interposed in the clearance S between the pedestal part 3*a* of the mount body 3 and the base part 2*a* of the pallet base 2.

As illustrated in FIG. 2, a plurality of glass plates G are placed in a stacked state on the pedestal part 3*a* of the mount body 3 and rest against the backrest part 3*b* with a protective sheet SI such as inserting paper or a foaming resin sheet being interposed between the individual glass plates G. Plate members such as cushion members cover the front side, both sides, and the top side of the glass pates G, and a belt or stretch film is wound around the plate members over the pallet 1 and is fixed to the pallet 1, whereby a glass plate package body can be obtained. It is to be noted that the first embodiment is particularly effective when the glass plates to be used for glass substrates for liquid crystal displays are used, but can demonstrate a sufficient effect even for the glass substrates for other flat panel displays.

Figure 5:
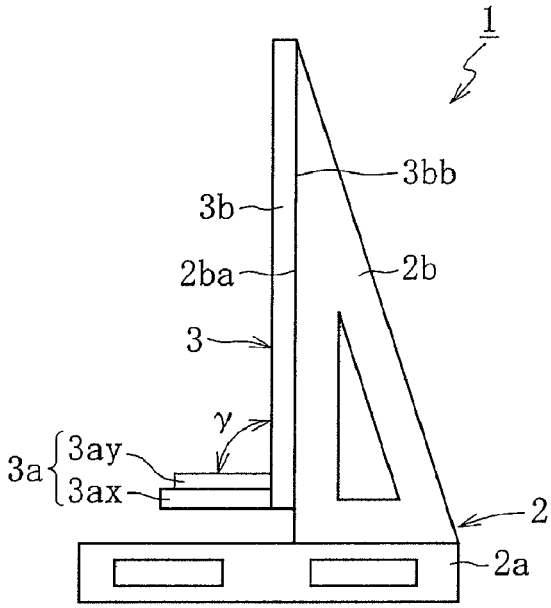
FIG. 5 is a side view schematically illustrating a glass plate packaging pallet according to a second embodiment of the present invention.

FIG. 5 is a side view schematically illustrating a glass plate packaging pallet according to a second embodiment of the present invention. As illustrated in the diagram, a pallet 1 according to the second embodiment differs from the pallet 1 according to the first embodiment in that the front surface 2*ba* of the backside part 2*b*, secured onto and integrated with the base part 2*a* of the pallet base 2 and having an approximately right triangular shape as viewed from the sides is a vertical plane equivalent to the long side, and that the angle defined by the backrest part 3*b* of the mount body 3 and the pedestal part 3*a* is 90°, and hence the pedestal part 3*a* is in parallel to the top surface of the base part 2*a*. Since the other components are identical in both embodiments, their descriptions are omitted with same reference symbols given to the common components in the diagram.

Figure 6:
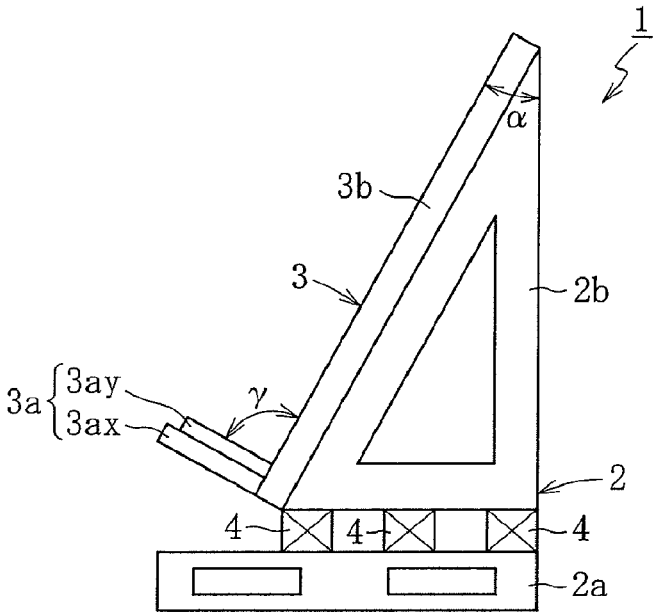
FIG. 6 is a side view schematically illustrating a glass plate packaging pallet according to a third embodiment of the present invention.

FIG. 6 is a side view schematically illustrating a pallet 1 according to a third embodiment of the present invention. As illustrated in the diagram, the pallet 1 according to the third embodiment differs from the pallet 1 according to the first embodiment in that the base part 2*a* of the pallet base 2 and the backside part 2*b* thereof are integrated with each other with the cushion member 4 made of a spring, a rubber cushion, or the like being interposed therebetween. Therefore, the backside part 2*b* and the mount body 3 are elastically supported on the base part 2*a*. Since the other components are identical in both embodiments, their descriptions are omitted with same reference symbols given to the common components in the diagram. According to the pallet 1 of the third embodiment, vibration or shock occurring at the base part 2*a* of the pallet base 2 is relaxed by the cushioning performance of the cushion member 4 before acting on the backside part 2*b*, thus making it difficult for vibration or shock to adversely affect the mount body 3 and eventually the glass plates G.

Figure 7:
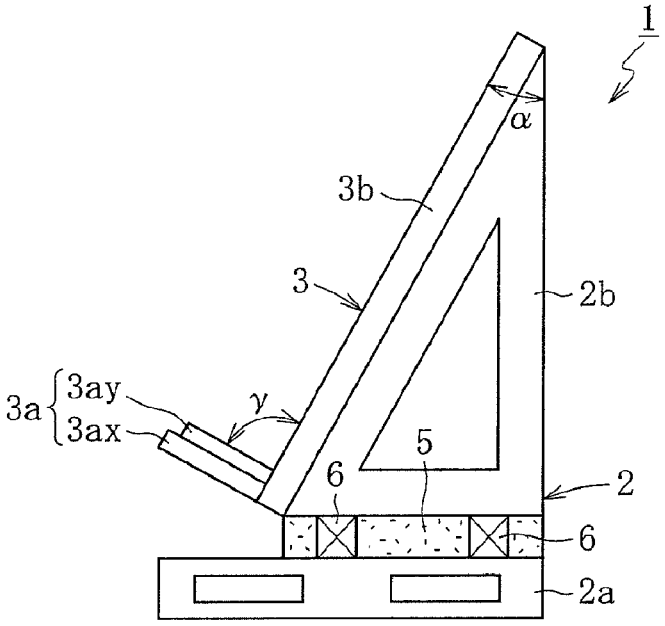
FIG. 7 is a side view schematically illustrating a glass plate packaging pallet according to a fourth embodiment of the present invention.

FIG. 7 is a side view schematically illustrating a pallet 1 according to a fourth embodiment of the present invention. As illustrated in the diagram, the pallet 1 according to the fourth embodiment differs from the pallet 1 according to the third embodiment in that a cushion member to be interposed between the base part 2*a* of the pallet base 2 and the backside part 2*b* is formed by a combination of a foam 5 and a floating bolt mechanism 6. Since the other components are identical in both embodiments, their descriptions are omitted with same reference symbols given to the common components in the diagram.

Example

Figure 8:
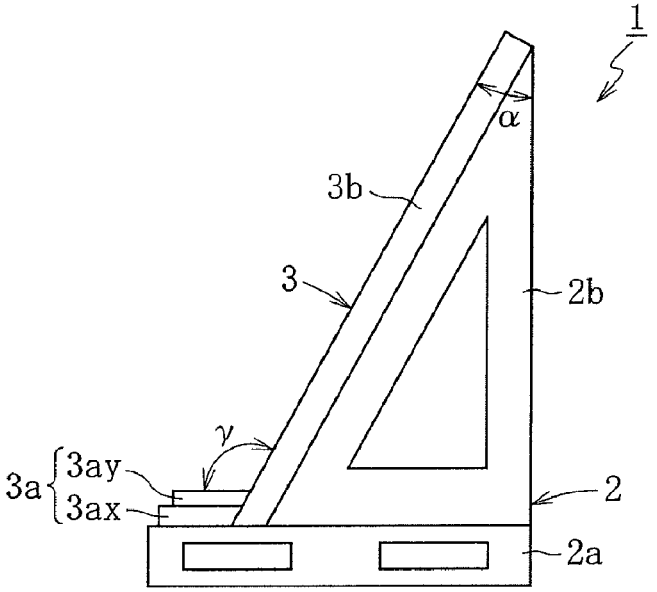
FIG. 8 is a side view schematically illustrating a glass plate packaging pallet according to a comparative example.

In order to check if the present invention would achieve the desired object, examinations given below were conducted and reviewed. As Example 1 of the present invention, sixteen pallets 1 illustrated in FIGS. 1 and 2 were prepared with the inclination angle α of the backrest part 3*b* with respect to the vertical plane being set to 20°, the angle γ of the backrest part 3*b* with respect to the pedestal part 3*a* being set to 90°, and the glass plate receiving surface 3*aa* being a single flat surface (widthwise length L of 2050 mm). Then, three hundred glass plates G each having a horizontal size of 2000 mm, a vertical size of 1500 mm, and a thickness of 0.7 mm were placed on each of the sixteen pallets to be packed, and were transported on a truck and by a marine container. The transportation resulted in no glass plates G being broken. As Example 2 of the present invention, twelve pallets 1 illustrated in FIG. 6 were prepared with the inclination angle α of the backrest part 3*b* with respect to the vertical plane being set to 10°, the angle γ of the backrest part 3*b* to the pedestal part 3*a* being set to 100°, the cushion member 4 being a rubber cushion, and the glass plate receiving surface 3*aa* being a single flat surface (widthwise length L of 1200 mm). Then, four hundred glass plates G each having a horizontal size of 1300 mm, a vertical size of 1200 mm, and a thickness of 0.7 mm were placed on each of the twelve pallets to be packed, and were transported on a truck and by a marine container. The transportation resulted in no glass plates G being broken. Further, as Example 3 of the present invention, sixteen pallets 1 illustrated in FIG. 7 were prepared with the inclination angle α of the backrest part 3*b* with respect to the vertical plane being set to 20", the angle γ of the backrest part 3*b* with respect to the pedestal part 3*a* being set to 90°, and the glass plate receiving surface 3*aa* being a flat surface divided into four parts each having a width of 250 mm (widthwise length L of 1850 mm). Then, three hundred glass plates G each having a horizontal size of 2000 mm, a vertical size of 1500 mm, and a thickness of 0.7 mm were placed on each of the sixteen pallets to be packed, and were transported on a truck and by a marine container. The transportation resulted in no glass plates G being broken. As a comparative example to those examples of the present invention, sixteen pallets 1 each having the pedestal part 3*a* fixed to the base part 2*a* as illustrated in FIG. 8 were prepared with the inclination angle α of the backrest part 3*b* with respect to the vertical plane being set to 20°, the angle γ of the backrest part 3*b* with respect to the pedestal part 3*a* being set to 110°, and the glass plate receiving surface 3*aa* being a single flat surface (widthwise length L of 2050 mm). Then, three hundred glass plates G each having a horizontal size of 2000 mm, a vertical size of 1500 mm, and a thickness of 0.7 mm were placed on each of the sixteen pallets to be packed, and were transported on a truck and by a marine container. The transportation resulted in 56 glass plates G being broken. The above-mentioned examinations illustrate that even if the base part 2*a* of the pallet base 2 is deformed at the time of placing each pallet 1 according to the present invention on the floor surface, load-carrying surface or the like having irregularity, at the time of lifting the pallet 1 with a forklift, at the time of transporting, and so on when vibration or shocks are likely to occur, the pallet 1 can properly support the glass plates G without being affected by the deformation.

The invention claimed is:

1. A glass plate packaging pallet, comprising:

a pallet base including a base part and a backside part, said base part having a rear side, and being integrated with said backside part, such that said backside part rises from said rear side of said base part, said glass plate packaging pallet being configured so that a plurality of glass plates are capable of being disposed so as to be stacked with an upright posture above said base part and in front of said backside part, wherein:

said glass plate packaging pallet further comprises a mount body including a pedestal part and a backrest part, said pedestal part being integrated with said backrest part, said pedestal part being disposed above said base part and being configured to support the glass plates from below, said backrest part being disposed in front of said backside part and being configured to support the glass plates resting thereagainst, said glass plate packaging pallet is configured such that a rear surface of said backrest part and a front surface of said backside part are fixed together so as to face each other along the same plane so that said mount body is fixed to said pallet base only by said backrest part, and said pedestal part is positioned in a non-connected state with respect to said base part so that a force of deformation of said backside part involved with deformation of said base part is received between said front surface of said backside part and said rear surface of said backrest part;

said mount body is disposed only on one side of said pallet base, and the pedestal part is an integral structure having a metal plate body with a top surface and a bottom surface, said top surface being a flat surface, a receiving member formed of foam resin or rubber is fixed to said top surface of said metal plate body, and an entirety of said bottom surface of said pedestal part is completely separated from said base part.

2. A glass plate packaging pallet according to claim 1, wherein a clearance is provided between a bottom of said pedestal part of said mount body and a top surface of said base part of said pallet base.

3. A glass plate packaging pallet according to claim 1, wherein a cushion member is provided so as to be interposed between a bottom of said pedestal part of said mount body and a top surface of said base part of said pallet base.

4. A glass plate packaging pallet according to claim 1, wherein said top surface of said metal plate body is a glass plate receiving surface and said flat surface is a single flat surface.

5. A glass plate packaging pallet according to claim 1, wherein said top surface of said metal plate body is a glass plate receiving surface and comprises said flat surface as one of two or more parts divided in a direction perpendicular to a front-back direction.

6. A glass plate packaging pallet according to claim 1, wherein said backside part is integrated on said base part of said pallet base in an elastically supported state.

7. A glass plate packaging pallet according to claim 6, wherein said backside part is attached onto said base part of said pallet base through an intermediation of a cushion member.

8. A glass plate packaging pallet according to claim 1, wherein an angle defined by a front surface of said backrest part of said mount body and a vertical plane has a lower limit of 0° and an upper limit of an inclination angle of 45° at which a lower side of said front surface of said backrest part extends frontward more than an upper side of said front surface of said backrest part.

9. A glass plate packaging pallet according to claim 1, wherein an angle defined by a top surface of said pedestal part of said mount body and a horizontal plane has a lower limit of 0° and an upper limit of an inclination angle of 75° at which a rear side of said top surface of said pedestal part extends downward more than a front side of said top surface of said pedestal part.

10. A glass plate packaging pallet according to claim 1, wherein an angle defined by a front surface of said backrest part of said mount body and a top surface of said pedestal part has a lower limit of 60° and an upper limit of 135°, and an angle defined by said top surface of said pedestal part of the mount body and a horizontal plane has a lower limit of 0°.

11. A glass plate package body, wherein a plurality of glass plates disposed so as to be stacked with an upright posture is packed by being arranged on said mount body of said glass plate packaging pallet according to claim 1 while a protective sheet is interposed between said individual glass plates.

12. A glass plate package body according to claim 11, wherein each of said packed glass plates has a thickness of 0.7 mm or less, and one side with a size of 1,000 mm or more.

* * * * *